US007859177B2

(12) United States Patent
Yoshimoto et al.

(10) Patent No.: US 7,859,177 B2
(45) Date of Patent: Dec. 28, 2010

(54) SPARK PLUG FOR INTERNAL-COMBUSTION ENGINES

(75) Inventors: Osamu Yoshimoto, Nagoya (JP); Wataru Matsutani, Nagoya (JP)

(73) Assignee: NGK Spark Plug Co., Ltd., Nagoya, Aichi (JP)

( * ) Notice: Subject to any disclaimer, the term of this patent is extended or adjusted under 35 U.S.C. 154(b) by 1023 days.

(21) Appl. No.: 11/600,318

(22) Filed: Nov. 16, 2006

(65) Prior Publication Data

US 2007/0159046 A1 Jul. 12, 2007

(30) Foreign Application Priority Data

Nov. 16, 2005 (JP) ..... 2005-331468

(51) Int. Cl.
*H01T 13/20* (2006.01)
*C22C 19/05* (2006.01)

(52) U.S. Cl. ..... 313/141; 313/143; 313/144; 148/419; 148/428; 420/455

(58) Field of Classification Search ..... None
See application file for complete search history.

(56) References Cited

U.S. PATENT DOCUMENTS 5,755,897 A * 5/1998 Brill ..... 148/410
6,472,801 B1 * 10/2002 Matsubara et al. ..... 313/141
6,761,854 B1 * 7/2004 Smith et al. ..... 420/443
2002/0158559 A1 10/2002 Sugiyama et al.
2004/0013560 A1 * 1/2004 Hrastnik ..... 420/455

FOREIGN PATENT DOCUMENTS

| | | |
|---|---|---|
| JP | 2000-336446 | 12/2000 |
| JP | 2002-129268 | 5/2002 |
| JP | 2002-235138 | 8/2002 |
| JP | 2002-260818 | 9/2002 |

OTHER PUBLICATIONS

Patent Abstracts of Japan, Patent & Utility Model Gazette DB, Japanese Patent Application Laid-Open (kokai) No. 2002-235138, abstract (1 page in English) and claims (1 page in English); http://www4.ipdl.ncipi.go.jp/Tokujitu/tjsogodbenk.ipdl.

* cited by examiner

*Primary Examiner*—Nimeshkumar D Patel
*Assistant Examiner*—Tracie Green
(74) *Attorney, Agent, or Firm*—Stites & Harbison PLLC; Jeffrey A. Haeberlin

(57) ABSTRACT

A spark plug for an internal-combustion engine is provided wherein the central and ground electrodes exhibit a long service life and wherein the fatigue strength at high temperatures is improved. The ground electrode is made from an alloy comprised of nickel (Ni) as a primary component, chromium: 20-30% by weight, iron: 7-20% by weight, aluminum: 1-3% by weight, titanium: 0.05-0.5% by weight, manganese: not higher than 0.1% by weight, silicon: not higher than 0.1% by weight, and carbon: not higher than 0.5% by weight. The alloy further includes at least one specific element selected from zirconium, yttrium, neodymium, cerium, lanthanum and samarium. Further, the total content of the specific element group is 5% or more of the aluminum content and is not higher than 1% by weight.

9 Claims, 2 Drawing Sheets

SPARK PLUG FOR INTERNAL-COMBUSTION ENGINES

FIELD OF THE INVENTION

The present invention relates to spark plugs for use in internal-combustion engines.

BACKGROUND OF THE INVENTION

Conventional spark plugs for internal combustion engines, such as an automobile engine, include a central electrode and a ground electrode. There has been a continuing demand for a material to be used for the central and ground electrodes of a spark plug which has such characteristics as a favorable oxidation resistance in the high temperature environment of a spark plug, less spark erosion, favorable thermal conductivity, high durability at high temperatures, favorable machinability and the like. For the ground electrode, a particular characteristic that is in demand is favorable weldability. Currently, the material generally employed in attempting to satisfy these demands is a heat-resistant nickel (Ni) alloy.

There has been disclosed in the prior art (see, e.g., Japanese Patent Application Laid-Open (kokai) No. 2002-235138) a heat-resistant nickel alloy which contains: chromium (Cr) in a range from 10 to 25% by weight; iron (Fe) in a range from 0.5 to 10% by weight; aluminum (Al) in a range from 0.3 to 3.2% by weight; silicon (Si) in a range from 0.2 to 2.2% by weight; manganese (Mn) in a range from 0.1 to 0.8% by weight; magnesium (Mg) less than 0.001% by weight; sulfur (S) less than 0.002% by weight; and which further contains nickel (Ni) and indispensable impurities as the remainder. By using such a nickel alloy material containing a relatively high Cr content, the oxidation resistance, which is attributed to a Cr oxide film formed on the surface of the corresponding electrode, is improved.

SUMMARY OF THE INVENTION

Although the above-mentioned improvement in the oxidation resistance contributes to reinforcement of the associated spark plug, and even though an improvement in the oxidation resistance is achieved, there is, for example, the possibility that breakage of the ground electrode may still occur due to the insufficient fatigue strength of the corresponding electrode at high temperatures. Specifically, when the spark plug is subjected to long-term use, there is a possibility that aluminum nitride may be formed in a grain boundary located under the CR oxide film due to nitrogen penetrating under the Cr oxide film. As a result, the fatigue strength at high temperatures is likely to deteriorate because of the thus-formed aluminum nitride. The present invention addresses these problems, and one object of the invention is to provide a spark plug which has excellent oxidation resistance, and which, in particular, offers improved durability of the central electrode and the ground electrode through the use of a material that holds up under long-term use and has sufficient fatigue strength at high temperatures. As a result, the spark plug exhibits long service life.

According to one aspect of the invention, there is provided a spark plug, such as used for an internal-combustion engine, comprising: a central electrode; and a ground electrode disposed so that an electric discharge gap is formed therebetween, wherein at least one said central electrode and said ground electrode is at least partially made of nickel alloy containing: nickel as a primary component; Cr in a range from 20 to 30% by weight; Fe in a range from 7 to 20% by weight; Al in a range from 1-3% by weight, and further containing one or more type of elements selected from zirconium (Zr), yttrium (Y), neodymium (Nd), cerium (Ce), lanthanum (La), and samarium (Sm) as a specific element group, and wherein the total content of said specific element group is 5% or more of the Al content. The phrase "Ni as a primary component" as used herein means that the amount of nickel contained in the nickel alloy is predominant.

According to this aspect of the invention, either the central electrode or the ground electrode or both is at least partially made of a nickel alloy material including a high Cr content in addition to Fe and Al. With this relatively high Cr content, a substantial improvement in oxidation resistance is attained.

It has been found that when the Cr content is less than about 20% by weight, a durable Cr oxide film is not formed on the surface of the electrodes, and the oxidation resistance provided is likely to be insufficient. On the other hand, when the Cr content exceeds about 30% by weight, a deterioration in the machinability of the electrode as well as a deterioration in spark erosion resistance due to poor thermal conductivity are both likely to occur. However, with the Cr content in a range from about 20 to 30% by weight, a durable Cr oxide film is formed and the adequate oxidation resistance is obtained. Moreover, neither machinability nor spark erosion resistance deteriorates.

Further, with an Al content more than about 1% by weight, an aluminium oxide is formed directly under the Cr oxide film, thereby further improving oxidation resistance. It has been found that when the Al content exceeds about 5% by weight, the machinability and the weldability of a noble metal chip deteriorate. With the composition described above, since the Al content is in a range from about 1 to 5% by weight, sufficient oxidation resistance, machinability and weldability are obtained. Preferably, the Al content is in a range from about 1 to 3% by weight.

It has also been determined that a Fe content less than about 7% by weight causes poor machinability. On the other hand, when the Fe content exceeds about 20% by weight, the fatigue strength at high temperatures deteriorates. With the composition described above, since the Fe content is in a range from about 7 to 20% by weight, sufficient machinability and fatigue strength at high temperatures are obtained.

With this composition, the secure Cr oxide film, and the Al oxide produced directly under the Cr oxide film, enhance oxidation resistance and extend the service life of the associated spark plug, as compared with a conventional spark plug.

Further, in order to avoid breakage of the electrode caused by lack of fatigue strength at high temperatures, according to one aspect of the invention, the nickel alloy material contains, in addition to the above-mentioned material, at least one of a specific element group selected from Zr, Y, Nd, Ce, La and Sm. Elements of this specific element group deposit in the grain boundary and prevent formation of aluminum nitride. However, when the total content of the specific element group is less than about 5% of the Al content, the effect is likely to be insufficient. According to the invention, the total content of the specific element group is 5% or more of the Al content, thereby substantially preventing the formation of aluminum nitride. Thus, good fatigue strength at high temperatures can be obtained, and the durability of the central electrode and the ground electrode is improved. As a result, a long service life for the associated spark plug is achieved.

It is noted that the weldability of a discharge portion made of a noble metal to the central electrode or the ground electrode is also improved, as compared to a conventional spark plug.

It will be understood that the above-described nickel alloy can be used for (i) the whole of the central electrode or the ground electrode, or (ii) as a surface layer on either electrode, while the internal core of the electrode is made of a heat conductive material, like copper.

Preferably, the total content of said specific element group is about 1% or less by weight. It has been determined that when the total content of the specific element group exceeds about 1% by weight, the machinability of the material is likely to deteriorate. By limiting the total content of said specific element group to about 1% or less by weight, adequate machinability is obtained.

Preferably, the Ni alloy further contains titanium (Ti) in a range from about 0.05 to 0.5% by weight.

Ti forms a compound with nitride in the electrode material, and forms carbide when C is contained therein, thereby preventing crystal grain growth. Large crystal grains may cause breakage of the ground electrode. On the other hand, when the Ti content exceeds about 0.5% by weight, electrode weldability becomes poor, and internal oxidation is accelerated, resulting in a deterioration in oxidation resistance. According to this embodiment of the invention, since Ti content is in a range from about 0.05 to 0.5% by weight, crystal grain growth can be controlled, and adequate weldability and oxidation resistance are maintained.

Preferably, the Ni alloy further contains at least one element selected from Mn and Si wherein the Mn content is not higher than about 0.5% by weight, and the Si content is not higher than about 0.5% by weight.

Mn and Si act as a deoxidation material in the process of producing the electrode material. In particular, such a deoxidation material removes oxygen from the electrode material, thereby facilitating anti-oxidization. Further, by including a small amount of Mn and Si, the oxidation resistance of the electrode material improves. However, when an excessive amount of either is included (i.e., when the Mn and Si content exceeds about 0.1% by weight, or the C content exceeds 0.5% by weight), the machinability deteriorates. With this embodiment, since the nickel alloy contains Mn and Si not higher than about 0.5% by weight, respectively, sufficient oxidation resistance can be obtained. while maintaining adequate machinability.

Preferably, the nickel alloy contains at least one element selected from (i) Mn in a range from about 0.05 to 0.5% by weight (more preferably, in a range from about 0.05 to 0.1% by weight) and (ii) Si in a range from about 0.05 to 0.5% by weight (more preferably, in a range from about 0.05 to 0.1% by weight), respectively.

Preferably, the nickel alloy further contains carbon in a range from about 0.12 to 0.5% by weight.

The addition of carbon enhances the strength of the nickel alloy and thereby improves the strength under high temperature conditions. Further, carbon has the effect of preventing crystal grain growth so that breakage of the electrode can be prevented. However, it has been found that if the content of carbon exceeds about 0.5% by weight, machinability is likely to deteriorate. A carbon content from about 0.12 to 0.5% by weight results in adequate grain growth and enhancing strength under high temperature, while securing sufficient machinability.

Preferably, the nickel alloy contains nickel in an amount not more than 70% by weight.

With an Ni component of 70% by weight or less, the spark corrosion durability of the nickel alloy is enhanced. This is because, among the three major components, Ni, Fe and Cr, Ni has a lower melting point than the others. More preferably, the nickel alloy contains nickel in a range from about 55 to 65% by weight.

Preferably, the nickel alloy contains at least both yttrium and zirconium among the specific element group.

A synergistic effect of including yttrium and zirconium is that nitriding of the Al component can be effectively suppressed. Therefore, sufficient fatigue strength can be maintained so that the lifetime of the corresponding spark plug can be extended.

More preferably, the ratio of yttrium to zirconium is from about 0.5 to 2.0 so as to produce the above-mentioned synergistic effect.

Preferably, the ground electrode is at least partially made of said nickel alloy. Since a ground electrode is normally formed in a more slender shape and is longer than the central electrode, and is therefore exposed to a higher temperature than the central electrode, higher strength under high temperature conditions is required for the ground electrode. Therefore, the nickel alloy described above is particularly suitable for the ground electrode.

On the other hand, the strength under high temperature conditions required by the central electrode is not as great as that for the ground electrode. The machinability required for the central electrode is normally higher than that for the ground electrode, because the central electrode normally has a more complex shape than the ground electrode.

Therefore, depending on the particular use of a spark plug, the total content of said specific element group in the central electrode is preferably smaller than said total content of the specific element group in the ground electrode, and, in some embodiments, can be zero.

It is noted that a decision as to whether or not the material of the electrode is within the scope of the present invention, can be determined by, for example, an electron probe microanalyzer (EPMA).

Further features and advantages of the present invention will be set forth in, or apparent from, the detailed description of preferred embodiments thereof which follows.

DESCRIPTION OF THE PREFERRED EMBODIMENTS

Hereafter, an embodiment of the present invention will be described with reference to drawings.

Figure 1:
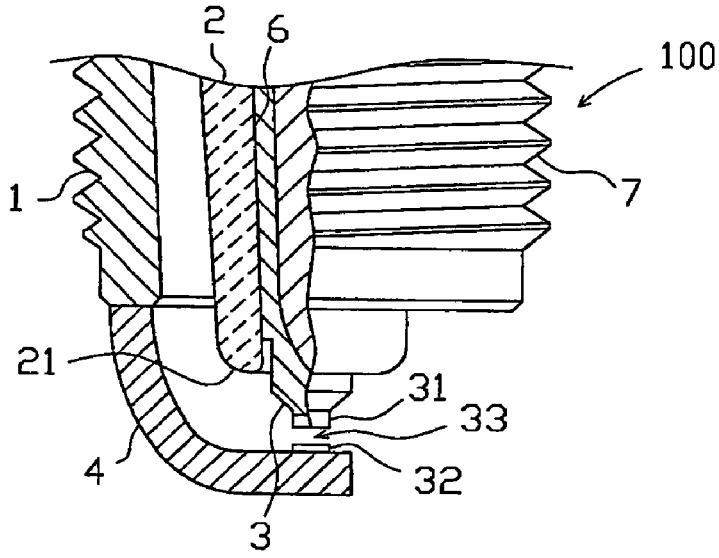
FIG. 1 is a fragmentary side elevational view, partially in cross section, showing the construction of a typical spark plug.

As shown in FIG. 1, a spark plug 100 of this embodiment is comprised of a metallic shell 1, an insulator 2, a central electrode 3 and a ground electrode 4. The metallic shell 1 has a cylindrical form accommodating the insulator 2 therein. A front end portion 21 of the insulator 2 projects from the metallic shell 1. Further, the central electrode 3 is accommodated inside the insulator 2 so that a discharge portion 31 thereof may project from the insulator 2. Furthermore, the ground electrode 4 is disposed so that a rear end portion thereof may be welded to the metallic shell 1, the front end side thereof may be bent towards the central electrode 3 and the side face thereof may face a front end portion of the central electrode 3. The ground electrode 4 is formed with a discharge portion 32 opposed to the discharge portion 31. A gap formed between the discharge portion 31 and the discharge portion 32 serves as a spark discharge gap 33.

The insulator 2 is made of sintered ceramic, such as alumina or aluminum nitride or the like. For mating with the central electrode 3 in an axial direction of the insulator 2, the insulator has formed therein a through-hole 6. The metallic shell 1 is cylindrical in shape, and is made of metal, such as low carbon steel. Moreover, the metallic shell 1 constitutes a housing of the spark plug 100, and has an external periphery forming a screw section 7 for mounting the spark plug 100 on a cylinder head of an engine (not shown).

Figure 2:
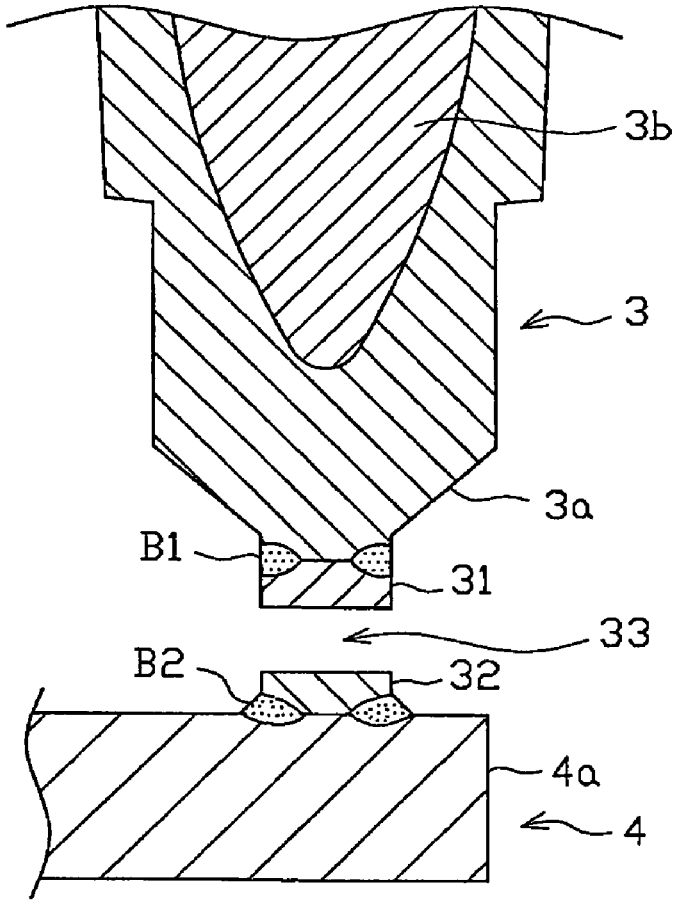
FIG. 2 is a fragmentary side elevational view, partially in cross section, showing the discharge portions provided in each main body of a central electrode and a ground electrode.

Referring to FIG. 2, a main body 3*a* of the central electrode 3 and a main body 4*a* of the ground electrode 4 are principally comprised of a nickel alloy. The central electrode 3 further includes a core rod 3*b* embedded in the main body 3*a*. The core rod 3*b* is made of a high heat conductive material, e.g. copper. The ground electrode 4 can also employ such a core rod embedded in the main body 4*a*.

In this embodiment, the composition of the alloy constituting the main body 4*a* of the ground electrode 4 has particular features, which will be described later in full detail. On the other hand, in this embodiment, the discharge portion 31 and the discharge portion 32 opposed to the discharge portion 31 are made of an iridium (Ir) alloy or a platinum (Pt) alloy.

The main body 3*a* of the central electrode 3 has a tapered front end side and a flat front end face. A disc-like chip made of alloy composition constituting the discharge portion 31 is placed on the front end face. Further, the discharge portion 31 is formed in such a manner that an outer circumference edge of a joint surface is welded by laser welding, electron beam welding, resistance welding or the like to form a welded portion B1 so that the disc-like chip is fixed to the front end face. Furthermore, the discharge portion 32 facing the discharge portion 31 is formed in such a manner that a chip is placed at a predetermined location on the ground electrode 4, and an outer circumferential edge of a joint surface is welded to form a welded portion B2 so that the chip is fixed to the ground electrode 4. In addition, the construction wherein either the discharge portion 31, or the discharge portion 32 opposed to the discharge portion 31, is omitted may be adopted. In this case, a spark discharge gap 33 is formed either between the discharge portion 31 and the ground electrode 4, or between the discharge portion 32 opposed to the discharge portion 31 and the central electrode 3.

In this specific embodiment, the main body 4*a* of the ground electrode 4 employs a dissolution alloy that is obtained by blending and dissolving each alloy constituent and is formed through the use of wire drawing dies or the like. The alloy constituting the main body 4*a* of the ground electrode 4 is comprised of: Ni as a primary component (about 55 to 70% by weight); Cr about 20 to 30% by weight; Fe about 7 to 20% by weight; Al about 1 to 5% by weight; Ti about 0.05 to 0.5% by weight; Mn not higher than about 0.5% by weight; Si not higher than about 0.5% by weight; C about 0.12 to 0.5% by weight; and at least one of the specific element group selected from Zr, Y, Nd, Ce, La and Sm. The total content of the specific element group is about 5% or more of Al content and about 1% by weight or less.

In the combination of each alloy content in the ground electrode 4, when the Cr content is less than about 20% by weight, a secure or durable Cr oxide film is not formed, thereby resulting in the oxidation resistance being insufficient. On the other hand, when the content of Cr exceeds about 30% by weight, machinability deteriorates, thereby contributing to deterioration in the spark erosion resistance due to poor thermal conductivity. However, in the spark plug 100 according to this embodiment, since the material constituting the main body 4*a* of the ground electrode 4 contains Cr in a range from about 20 to 30% by weight, a secure Cr oxide film is formed on the surface of the main body 4*a*, thereby resulting in adequate oxidation resistance. Further, the machinability and spark erosion resistance of the main body 4*a* does not deteriorate.

When the Al content is less than about 1% by weight, an oxide is unlikely to be formed directly under the Cr oxide film, thereby causing deterioration in the oxidation resistance provided. Further, when the Al content exceeds about 3% by weight, the machinability and weldability of a noble metal chip declines. In the spark plug 100 according to this embodiment, since the Al content is in a range from about 1 to 3% by weight, the oxidation resistance of the main body 4*a* of the ground electrode 4 is improved, and poor machinability and weldability are prevented.

Further, when Fe content is less than about 7% by weight, machinability deteriorates. On the other hand, when the Fe content exceeds about 20% by weight, durability at high temperature deteriorates. In the spark plug 100 according to this embodiment, since Fe content is in a range from about 7 to 20% by weight, adequate machinability of the main body 4*a* of the ground electrode 4 is obtained, while deterioration in durability at high temperatures is also prevented.

Further, Ti forms a compound with nitride in the material, and forms carbide when C is contained in the material, thereby preventing excessive crystal grain growth. Large crystal grain may cause breakage of the ground electrode 4. On the other hand, when the Ti content exceeds about 0.5% by weight, weldability becomes poor, and internal oxidation is accelerated, resulting in deterioration in the oxidation resistance provided. In the spark plug 100 according to this embodiment, since Ti content is in a range from about 0.05 to 0.5% by weight, large crystal grain growth in the main body 4*a* of the ground electrode 4 can be controlled, and further, poor weldability is prevented. In addition, internal oxidation is not accelerated. Therefore, the oxidation resistance of the main body 4*a* is improved, contributing to a long service life for the spark plug 100.

Mn and Si act as deoxidation material in the process of producing the material. The deoxidation material removes oxygen from the material, thereby facilitating anti-oxidization. Further, by including a small amount of Mn and Si, the oxidation resistance improves. However, when an excessive amount is included (i.e., when the Mn and Si content exceeds about 0.1% by weight, the machinability deteriorates. Since the spark plug 100 according to this embodiment contains Mn and Si in amounts not higher than about 0.5% by weight, respectively, effects such as preventing oxidization, and improving oxidation resistance can be attained without any deterioration of the machinability of the material.

Preferably, the Mn content is about 0.05 wt % or more, and more preferably, about 0.1 wt % or less.

Preferably, the Si content is about 0.05 wt % or more, and more preferably, about 0.1 wt % or less.

Further, the addition of carbon in a range from about 0.12 to 0.5% by weight enhances strength under high temperature conditions and controls grain growth without deteriorating machinability.

Further, since Ni content is about 70 wt % or less in this embodiment, the nickel alloy exhibits sufficient spark corrosion durability. More preferably, the Ni content is about 55 to 65% by weight.

According to this embodiment as described above, the secure Cr oxide film and the oxide with Al formed directly under Cr oxide film contribute to an improvement in oxidation resistance and to a longer service life for the spark plug, as compared to a conventional spark plug. However, even though the oxidation resistance is improved, for example, breakage of the ground electrode is still likely to occur because of a lack of fatigue strength at high temperatures.

Thus, in this embodiment, the main body 4*a* of the ground electrode 4 contains at least one or more elements selected from the group of Zr, Y, Nd, Ce, La and Sm, as a "specific element" group. This specific element group deposits on the grain boundary and can prevent a formation of aluminum nitride. However, when the total content of the specific element group is less than about 5% of Al content, the formation of aluminum nitride may not be adequately prevented. Further, when the total content of the specific element group exceeds about 1% by weight, the machinability of the material tends to deteriorate.

According to this embodiment, since the total content of the specific element group is about 5% or more of Al content, the formation of aluminum nitride can be fully prevented. Therefore, any deterioration in fatigue strength of the main body 4*a* of the ground electrode 4 at high temperature can be prevented, thereby improving the durability of the main body 4*a*. The result is a long service life for the spark plug 100 for internal-combustion engines. Further, since the total content of the specific element group is not higher than about 1% by weight, the machinability of the main body 4*a* does not deteriorate.

Further, as compared to a conventional spark plug, a significant improvement in weldability between the disc-like chip constituting the discharge portion 32 and the main body 4*a* of the ground electrode 4 was obtained when the material of the above-mentioned composition was employed.

In this embodiment, the main body 3*a* of the central electrode 3 is formed by mixing and melting the components, and die drawing the resultant alloy. The main body 3*a* of the central electrode 3 is made of a nickel alloy which contains nickel as a primary component, chromium in a range from about 20 to 30% by weight; iron in a range from about 7 to 20% by weight, and aluminum in a range from about 1 to 5% by weight, without containing any of the specific element group, i.e., any Zr, Y, Ce, Nd, La, or Sm.

This embodiment has a technical feature through containing the specific element group. The following shows the result of an experiment regarding changing the amount of the specific element content added to the material. In this experiment, the material contained Cr: 25.00% by weight, Al: 2.50% by weight, Fe: 10.00% by weight, Si: 0.10% by weight, Mn: 0.08% by weight, C: 0.17% by weight, Ti: 0.10% by weight and Ni: the remainder, and the specific element group was added thereto. The fatigue strength at a high temperature and the machinability of the material were evaluated.

stress amplitude conditions: pull/compression at 120 Mpa, repetition speed: 3000 rpm, and the number of repetitions: 108 cycles. In Table 1, a ground electrode having no fracture therein after the test is indicated by "o", and a ground electrode having no fracture observed therein after the test is indicated by "x".

In the evaluation of the machinability of the specimens, a circular bar with a diameter of 15 mm was processed to produce dimensions of 1.5 mm×2.8 mm in cross-section by cold working, and the evaluation was based on whether or not this was possible. In Table 1, "o" indicates that such cold working was successfully implemented, and "x" indicates that the cold working was not able to be implemented or that a crack was generated in the bar.

Referring to Table 1, as shown, sample No. 1 did not contain specific element group (i.e., was equivalent to a prior art sample). In this case, the fatigue strength at high temperature was unacceptable as indicated by the "x" and machinability was "o". As mentioned above, this result was attributed to aluminum nitride formed in the grain boundary.

Samples No. 2 to 7 each contained a different type of specific element in an amount of 1.00% by weight. Sample No. 2 contained Y and Sample No. 3 contained Zr. Similarly, Sample No. 4 contained Nd, Sample No. 5 contained Ce, Sample No. 6 contained La and Sample No. 7 contained Sm. The results were positive for machinability and fatigue strength at high temperature (as indicated by an "o"). By containing the specific element with an upper limit as the amount (1% by weight), the formation of aluminum nitride was fully prevented.

On the other hand, Sample No. 8 contained Y with 1.20% by weight, and Sample No. 9 contained Zr with 1.20% by weight. The result was negative ("x") for machinability. Thus, it is apparent that the machinability deteriorated when the content of the specific element exceeded the upper limit (1% by weight).

TABLE 1

| | Components (weight %) | | | | | | | | | | | | | | Fatigue strength | |
|---|---|---|---|---|---|---|---|---|---|---|---|---|---|---|---|---|
| No | Ni | Cr | Al | Fe | Si | Mn | C | Ti | Y | Zr | Nd | Ce | La | Sm | at hi- | machinerbility |
| 1* | 62.05 | 25.00 | 2.50 | 10.00 | 0.10 | 0.08 | 0.17 | 0.10 | | | | | | | X | o |
| 2 | 61.05 | 25.00 | 2.50 | 10.00 | 0.10 | 0.08 | 0.17 | 0.10 | 1.00 | | | | | | o | o |
| 3 | 61.05 | 25.00 | 2.50 | 10.00 | 0.10 | 0.08 | 0.17 | 0.10 | | 1.00 | | | | | o | o |
| 4 | 61.05 | 25.00 | 2.50 | 10.00 | 0.10 | 0.08 | 0.17 | 0.10 | | | 1.00 | | | | o | o |
| 5 | 61.05 | 25.00 | 2.50 | 10.00 | 0.10 | 0.08 | 0.17 | 0.10 | | | | 1.00 | | | o | o |
| 6 | 61.05 | 25.00 | 2.50 | 10.00 | 0.10 | 0.08 | 0.17 | 0.10 | | | | | 1.00 | | o | o |
| 7 | 61.05 | 25.00 | 2.50 | 10.00 | 0.10 | 0.08 | 0.17 | 0.10 | | | | | | 1.00 | o | o |
| 8* | 60.85 | 25.00 | 2.50 | 10.00 | 0.10 | 0.08 | 0.17 | 0.10 | 1.20 | | | | | | o | X |
| 9* | 60.85 | 25.00 | 2.50 | 10.00 | 0.10 | 0.08 | 0.17 | 0.10 | | 1.20 | | | | | o | X |
| 10 | 61.89 | 25.00 | 2.50 | 10.00 | 0.10 | 0.08 | 0.17 | 0.10 | 0.08 | 0.08 | | | | | o | o |
| 11 | 61.89 | 25.00 | 2.50 | 10.00 | 0.10 | 0.08 | 0.17 | 0.10 | | 0.08 | | 0.08 | | | o | o |
| 12 | 61.89 | 25.00 | 2.50 | 10.00 | 0.10 | 0.08 | 0.17 | 0.10 | | | 0.08 | | 0.08 | | o | o |
| 13 | 61.89 | 25.00 | 2.50 | 10.00 | 0.10 | 0.08 | 0.17 | 0.10 | 0.055 | 0.07 | | | | | o | o |
| 14* | 61.95 | 25.00 | 2.50 | 10.00 | 0.10 | 0.08 | 0.17 | 0.10 | 0.05 | 0.05 | | | | | X | o |
| 15 | 61.89 | 25.00 | 2.50 | 10.00 | 0.10 | 0.08 | 0.17 | 0.10 | 0.06 | 0.21 | | | | | o | o |
| 16 | 61.89 | 25.00 | 2.50 | 10.00 | 0.10 | 0.08 | 0.17 | 0.10 | 0.09 | 0.18 | | | | | o | o |
| 17 | 61.89 | 25.00 | 2.50 | 10.00 | 0.10 | 0.08 | 0.17 | 0.10 | 0.13 | 0.14 | | | | | o | o |
| 18 | 61.89 | 25.00 | 2.50 | 10.00 | 0.10 | 0.08 | 0.17 | 0.10 | 0.18 | 0.09 | | | | | o | o |
| 19 | 61.89 | 25.00 | 2.50 | 10.00 | 0.10 | 0.08 | 0.17 | 0.10 | 0.20 | 0.07 | | | | | o | o |

*comparative example

In the evaluation of fatigue strength at a high temperature shown in Table 1, a specimen of the ground electrode produced as specified was subjected to a rotating bending fatigue test according to JIS Z2274. Based on an axle weight fatigue test, the test machine was set as follows: temperature: 700° C., Sample Nos. 10 to 12 each contained two different types of specific elements, respectively. Further, each sample contained each element in an amount of 0.08% by weight. Sample No. 10 contained Y and Zr. Sample No. 11 contained Zr and Ce. Sample No. 12 contained Nd and La. The results were that fatigue strength at high temperature and machinability were both positive ("o"). The total content of two types of specific elements was 0.16% by weight, which is more than 0.125% by weight and which is equal to 5% of Al content of 2.50% by weight. Therefore, by adding such an amount of the specific element group, the formation of aluminum nitride was fully prevented.

Further, as shown in the table, deformation of sample No. 10 was the least during the rotating bending fatigue test among the sample Nos. 10 to 12.

Sample No. 13 contained Y 0.055% by weight and Zr 0.07% by weight. The total content of the specific element group was 0.125% by weight, which was exactly 5% of the Al content of 2.50% by weight. Also, the result was positive ("o") for both machinability and fatigue strength at high temperatures. On the other hand, Sample No. 14 contained Y 0.05% by weight and Zr 0.05% by weight. Thus, the total content of the specific element group was 0.10% by weight, which is less than 0.125% by weight and which is equal to 5% of Al content of 2.50% by weight. The resultant fatigue strength at high temperatures was negative ("x"). As a result, when the total content of the specific element group is less than 5% of Al content, the formation of aluminum nitride was not fully prevented and the fatigue strength at high temperatures deteriorated.

Sample Nos. 15 to 19 contained both yttrium (Y) and zirconium (Zr) 0.27% by weight in total, while the respective percentages of Y are 0.06% by weight, 0.09% by weight, 0.13% by weight, 0.18% by weight, and 0.20% by weight. Thus the respective ratios of Y to Zr are 0.29 (sample No. 15), 0.50 (sample No. 16), 0.93 (sample No. 17), 2.0 (sample No. 18) and 2.9 (sample No. 19). The resultant fatigue strength at high temperatures and machinability was positive ("o") in each sample.

Further, in view of the deformation of sample Nos. 15 to 19 during the rotating bending fatigue test, the deformation of sample Nos. 16 to 18 was smaller than sample Nos. 15 and 19.

It will be understood that the invention is not limited to the particular embodiment described above but may be changed or modified at least as follows:

In the above-mentioned experiment of the embodiment, although one or two types of a specific element were contained in the material of the main body 4*a*, three or more types of specific elements may so be contained. In this case, it is preferable that each of the specific elements be added in substantially equal percentages.

In the above-mentioned embodiment, a material with the above-mentioned composition was employed as the material constituting the ground electrode 4 (the main body 4*a*). In addition to this, a material with the above-mentioned composition may also be employed as a material constituting the central electrode 3 (the main body 3*a*).

The main body of the central electrode can be made of a nickel alloy containing the specific element group in a smaller amount than the main body of the ground electrode. For example, sample No. 14 can be used for the main body of the center electrode, while sample 10, among others, can be used for the main body of the ground electrode.

Although the invention has been described above in relation to preferred embodiments thereof, it will be understood by those skilled in the art that variations and modifications can be effected in these preferred embodiments without departing from the scope and spirit of the invention.

What is claimed is:

1. A spark plug comprising:

a central electrode; and a ground electrode disposed so that an electric discharge gap is formed between said central electrode and said ground electrode, wherein at least one of said central electrode and said ground electrode is at least partially made of a nickel alloy containing:

nickel as a primary component;

chromium in a range from 20 to 30% by weight;

iron in a range from 7 to 20% by weight;

aluminum in a range from 1 to 5% by weight; and a specific element group comprising at least yttrium and zirconium, with a ratio of yttrium to zirconium being from 0.5 to 2.0, and wherein the total content of said specific element group in said nickel alloy is at least 5% of the aluminum content.

2. The spark plug as claimed in claim 1, wherein the total content of said specific element group is 1% or less by weight.

3. The spark plug as claimed in claim 1, wherein said nickel alloy further contains titanium in a range from 0.05 to 0.5% by weight.

4. The spark plug as claimed in claim 1, wherein said nickel alloy further contains at least one of:

manganese not higher than 0.5% by weight, and silicon not higher than 0.5% by weight.

5. The spark plug as claimed in claim 1, wherein said nickel alloy further contains carbon in a range from 0.12 to 0.5% by weight.

6. The spark plug as claimed in claim 1, wherein said nickel alloy contains nickel not higher than 70% by weight.

7. The spark plug as claimed in claim 1, wherein said ground electrode is at least partially made of said nickel alloy.

8. The spark plug as claimed in claim 7, wherein said central electrode is at least partially made of a further nickel alloy containing:

nickel as a primary component;

chromium in a range from 20 to 30% by weight;

iron in a range from 7 to 20% by weight, and aluminum in a range from 1 to 5% by weight, said further nickel alloy not containing any of zirconium, yttrium, neodymium, cerium, lanthanum, and samarium.

9. The spark plug as claimed in claim 7, wherein said central electrode is at least partially made of a further nickel alloy containing:

nickel as a primary component;

chromium in a range from 20 to 30% by weight;

iron in a range from 7 to 20% by weight, aluminum in a range from 1 to 5% by weight, and at least one of a specific element group selected from zirconium, yttrium, neodymium, cerium, lanthanum, and samarium , and wherein the total content of said specific element group in said central electrode is smaller than the total content of the specific element group in said ground electrode.

* * * * *